US011629710B2

(12) United States Patent
Roberts

(10) Patent No.: US 11,629,710 B2
(45) Date of Patent: Apr. 18, 2023

(54) TORPEDO PLUNGER

(71) Applicant: PCS Ferguson, Inc., Frederick, CO (US)

(72) Inventor: Paul Treavor Roberts, Longmont, CO (US)

(73) Assignee: PCS Ferguson, Inc., Frederick, CO (US)

( * ) Notice: Subject to any disclaimer, the term of this patent is extended or adjusted under 35 U.S.C. 154(b) by 22 days.

(21) Appl. No.: 17/483,430

(22) Filed: Sep. 23, 2021

(65) Prior Publication Data

US 2022/0112792 A1 Apr. 14, 2022

Related U.S. Application Data

(60) Provisional application No. 63/089,115, filed on Oct. 8, 2020.

(51) Int. Cl.
*F04B 47/12* (2006.01)
*E21B 43/12* (2006.01)

(52) U.S. Cl.
CPC ..... *F04B 47/12* (2013.01); *E21B 43/121* (2013.01); *E21B 43/122* (2013.01)

(58) Field of Classification Search
CPC ..... E21B 43/122; E21B 43/13; E21B 43/12; E21B 43/121; E21B 33/068; E21B 34/06; F04B 47/12
See application file for complete search history.

(56) References Cited

U.S. PATENT DOCUMENTS 4,030,858 A * 6/1977 Coles, Jr. ..... F04B 47/12 417/56
2005/0241819 A1* 11/2005 Victor ..... E21B 43/127 166/68
2006/0124292 A1* 6/2006 Victor ..... E21B 43/121 166/105
2006/0249284 A1* 11/2006 Victor ..... E21B 43/121 166/105
2011/0253382 A1* 10/2011 Nadkrynechny ..... E21B 43/121 166/372

FOREIGN PATENT DOCUMENTS

CN 112983804 A * 6/2021

* cited by examiner

*Primary Examiner* — George S Gray
(74) *Attorney, Agent, or Firm* — Snell & Wilmer L.L.P.; Kent A. Lembke

(57) ABSTRACT

A plunger having a generally hollow interior between an open upper end of the plunger and a closed bottom end of the plunger. One or more orifices extend through a sidewall of the plunger near the closed bottom surface. The orifices fluidly connect the hollow interior of the plunger with the tubing below the plunger when the plunger is in use. The orifices allow for a transfer of gas from the well bottom into the liquid load above the plunger during plunger ascent. The orifices also allow liquids to pass through the plunger during plunger descent.

21 Claims, 7 Drawing Sheets

TORPEDO PLUNGER

CROSS-REFERENCE TO RELATED APPLICATIONS

This patent application is a non-provisional patent application of, and claims the benefit of, U.S. Provisional Patent Application No. 63/089,115, that is entitled "TORPEDO PLUNGER," that was filed on 8 Oct. 2020, and the entire disclosure of which is hereby incorporated by reference herein.

FIELD

The present disclosure relates to an artificial lift plunger for lifting formation liquids in a hydrocarbon well. More specifically the plunger is a passive bypass plunger having at least two fluid orifices that allow fluids to pass through the plunger during descent and that also allow gases to pass through the plunger during ascent.

BACKGROUND

A plunger lift is an apparatus that can be used to increase the productivity of oil and gas wells. In the early stages of a well's life, liquid loading may not be a problem. When production rates are high, well liquids are typically carried out of the well tubing by high velocity gas. As a well declines and production decreases, a critical velocity is reached wherein heavier liquids may not make it to the surface and start falling back to the bottom of the well exerting pressure on the formation, thus loading the well. As a result, gas being produced by the formation can no longer carry liquids to the surface. As gas flow rate and pressures decline in a well, lifting efficiency can decline substantially.

A plunger lift system can act to remove accumulated liquid in a well. That is, a plunger lift system may be used to unload liquids from a well. Such a plunger lift system utilizes gas present within the well as a system driver. The system works by cycling a plunger into and out of the well by cycling a well between a closed state and an open state. While the well is closed, the plunger falls to the bottom of the well passing through fluids in the production tubing. While the well is open, gas accumulating below the plunger pushes the plunger and liquid above the plunger in the production tubing to the surface. This removal of liquid from the tubing bore allows for the production of liquids (e.g., oil) and/or allows additional volumes of gas to flow from a producing well.

To improve production, it is desirable to reduce the cycle time of the plunger. That is, it is desirable to reduce the descent time of the plunger from the well surface to the well bottom. It is also desirable to reduce the ascent time of the plunger from the well bottom to the well surface. In some cases, large liquid loads above the plunger can cause the plunger lift to operate at a slowed rate. That is, a well's productivity can be impacted by the lift rate of the plunger caused by a heavy load.

SUMMARY

Presented herein is a plunger having improved descent and ascent characteristics. The plunger is similar in form to existing bar-stock or solid plungers. However, the presented plunger includes an upper mandrel section (e.g., generally cylindrical body or sleeve) having a hollow interior through at least a portion of the upper mandrel. That is, an interior passageway passes through a majority of the mandrel from a substantially closed bottom end to an open top end exiting through the top surface of the plunger (e.g., as viewed from above when the plunger is disposed within production tubing). This interior passageway (e.g., central passageway) may be aligned with a centerline axis of the generally cylindrical mandrel. At least one opening or orifice passes through a lower end of the plunger to fluidly connect the interior passageway extending through the mandrel with the tubing below the plunger. This orifice(s) allows for a transfer of gas from the well bottom into the liquid load above the plunger during plunger lift or ascent. This results in a 'jetting' of gas through the plunger, which causes an aeration of liquids above the plunger. Such aeration allows the plunger to carry a heavy liquid load to the well surface at a higher rise velocity. The orifice(s) also allows for fluids to pass through the plunger during descent allowing the plunger to more rapidly descend to the well bottom.

In an arrangement, an upper portion of the plunger has an outside diameter sized to fit within production tubing of a well. A lower end (e.g., bottom end) of the plunger has a reduced diameter. The plunger may taper from the reduced diameter bottom end to the outside diameter of the upper portion of the plunger. In an arrangement, the orifice(s) pass through the tapered portion of the plunger.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figure 1:
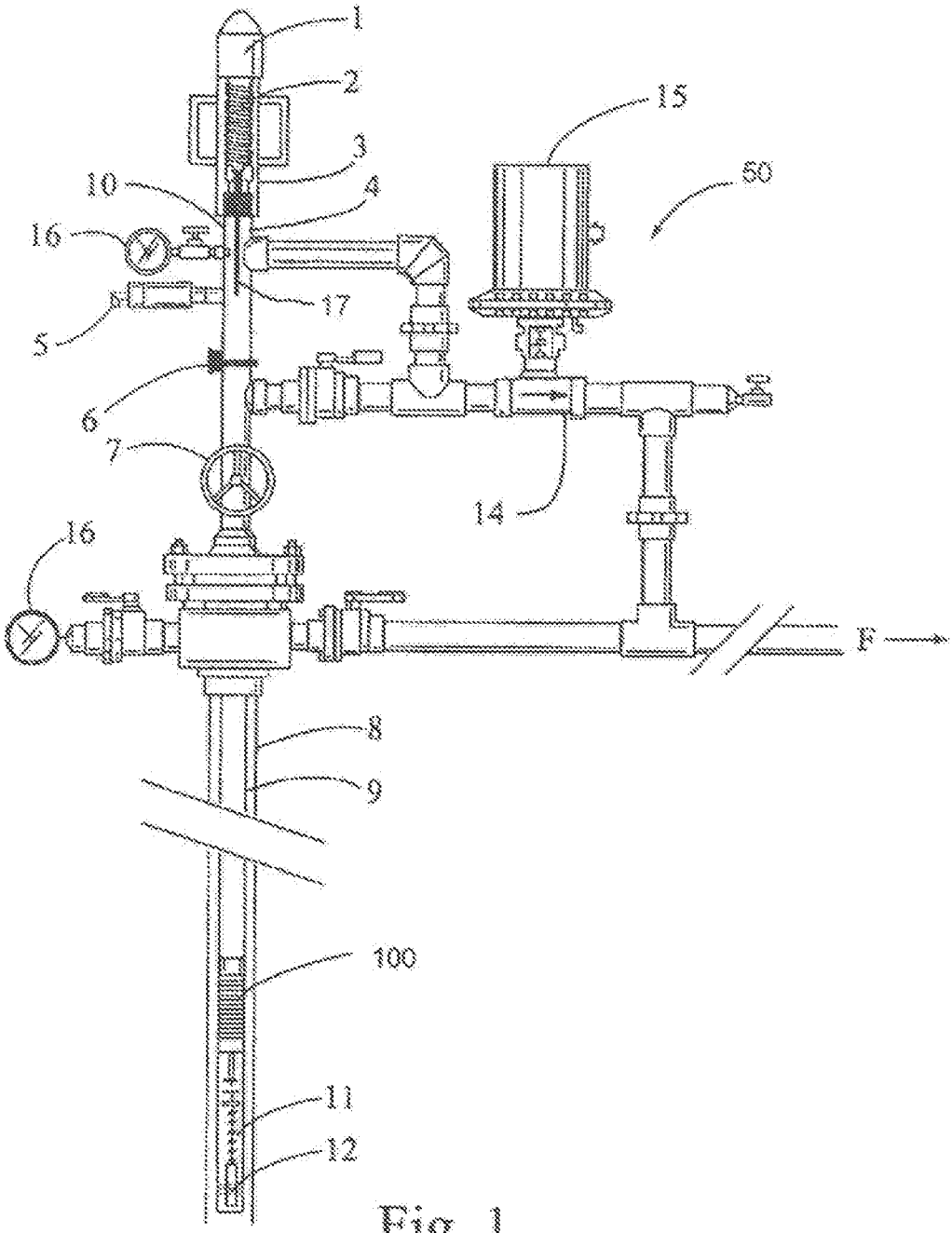
FIG. 1 illustrates a well head and production well.

A typical installation plunger lift system 50 can be seen in FIG. 1. The system includes what is termed a lubricator assembly 10 disposed on the surface above a well bore including casing 8 and production tubing 9. The lubricator assembly 10 is operative to receive a plunger 100 from the production tubing 9 and release the plunger 100 into the production tubing 9 to remove fluids (e.g., liquids) from the well. Fluid accumulating above of the plunger 100 at the bottom of the well may be carried to the top of the well by the plunger 100. Specifically, after passing through the liquids at the bottom of the well, gasses accumulate under the plunger 100 lifting the plunger 100 and the fluid accumulated above the plunger 100 to the surface. The plunger 100 of FIG. 1 can represent the plunger of the presented disclosure or other prior art plungers. In any arrangement, the lubricator assembly 10 controls the cycling of the plunger 100 into and out of the well. The lubricator assembly 10 includes a cap 1, integral top bumper spring 2, striking pad 3, and a receiving tube 4, which is aligned with the production tubing 9. When utilized with some prior art bypass plungers, the lubricator may further include an optional rod 17 that may extend through a plunger received by the lubricator to open a bypass valve or valve element of the plunger.

In some embodiments, the lubricator assembly 10 contains a plunger auto catching device 5 and/or a plunger sensing device 6. The sensing device 6 sends a signal to surface controller 15 upon plunger 100 arrival at the top of the well and/or dispatch of the plunger 100 into the well. When utilized, the output of the sensing device 6 may be used as a programming input to achieve the desired well production, flow times and wellhead operating pressures. A master valve 7 allows for opening and closing the well. Typically, the master valve 7 has a full bore opening equal to the production tubing 9 size to allow passage of the plunger 100 there through. The bottom of the well is typically equipped with a seating nipple/tubing stop 12. A spring standing valve/bottom hole bumper assembly 11 may also be located near the tubing bottom. The bumper spring is located above the standing valve and can be manufactured as an integral part of the standing valve or as a separate component of the plunger system.

Surface control equipment usually consists of motor valve(s) 14, sensors 6, pressure recorders 16, etc., and an electronic controller 15 which opens and closes the well at the surface. Well flow 'F' proceeds downstream when surface controller 15 opens well head flow valves. Controllers operate based on time, or pressure, to open or close the surface valves based on operator-determined requirements for production. Alternatively, controllers may fully automate the production process.

When motor valve 14 opens the well to the sales line (not shown) or to atmosphere, the volume of gas stored in the casing and the formation during the shut-in time typically pushes both the fluid load and the plunger 100 up to the surface. Forces which exert a downward pressure on a plunger can comprise the combined weight of the fluid above the plunger, the plunger itself as well as the operating pressure of the sales line together with atmospheric pressure. Forces which exert an upward pressure on a plunger can comprise the pressure exerted by the gas in the casing. Frictional forces can also affect a plunger's movement. For example, once a plunger begins moving to the surface, friction between the tubing and the fluid load opposes plunger movement. Friction between the gas and tubing also slows an expansion of the gas. However, in a plunger installation, generally it is only the pressure and volume of gas in the tubing and/or casing annulus which serves as the motive force for bringing the fluid load and plunger to the surface. Once received at the surface, the plunger may be immediately dispatched back into the well or held until a subsequent plunger cycle time.

Figure 2A:
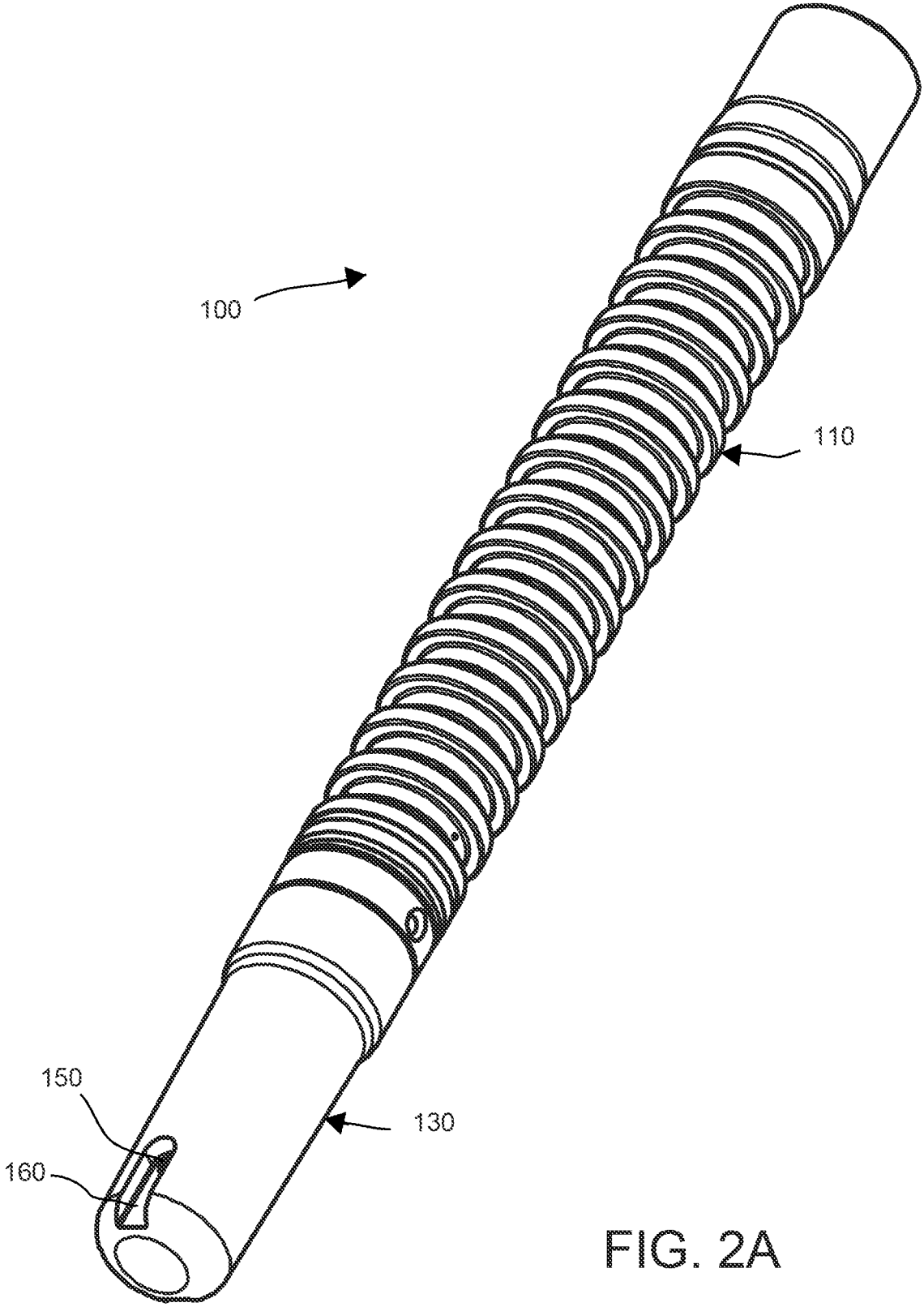
FIGS. 2A and 2B illustrate perspective and exploded perspective views, respectively, of a plunger in accordance with the disclosure.
Figure 2B:
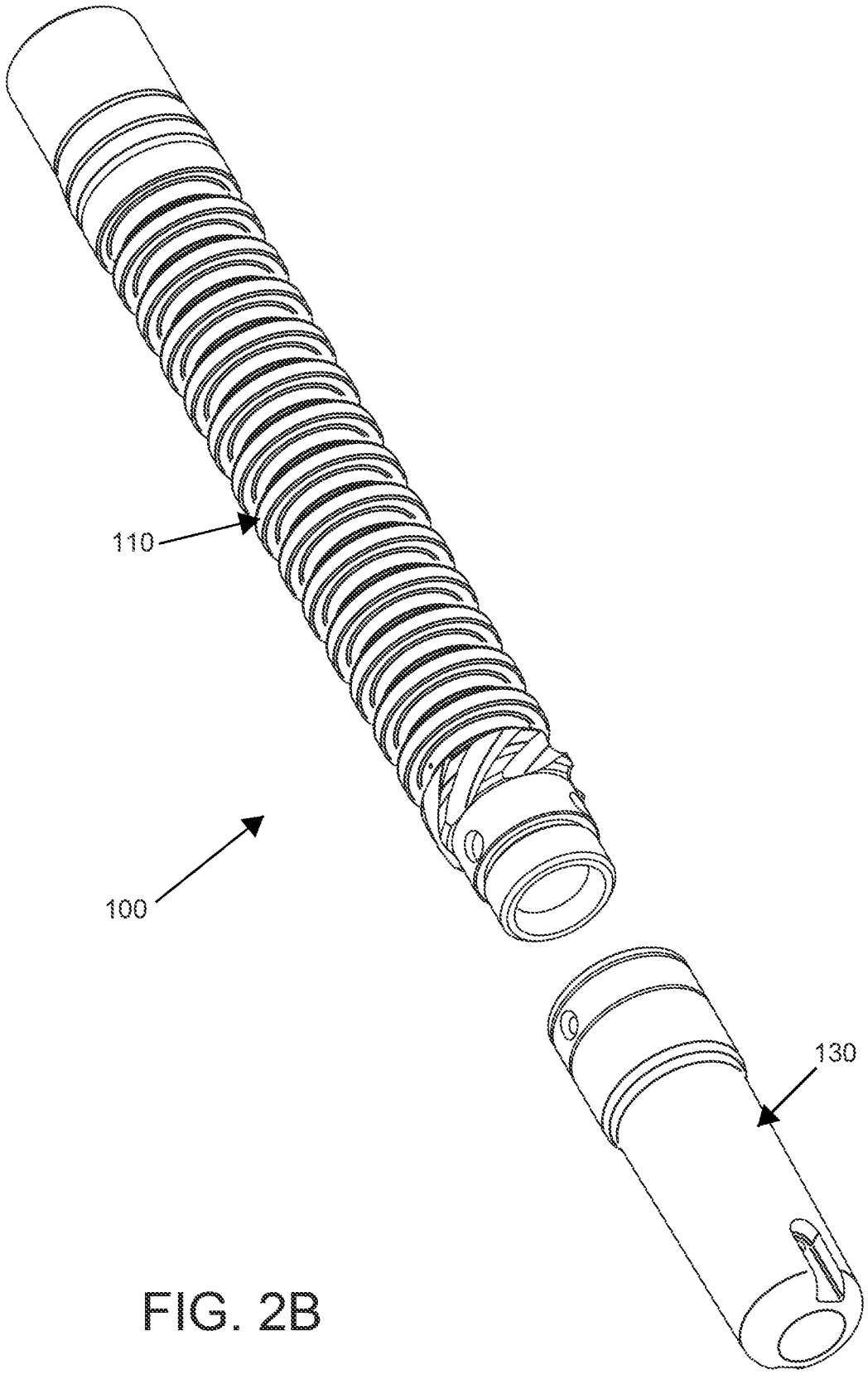
Figure 3A:
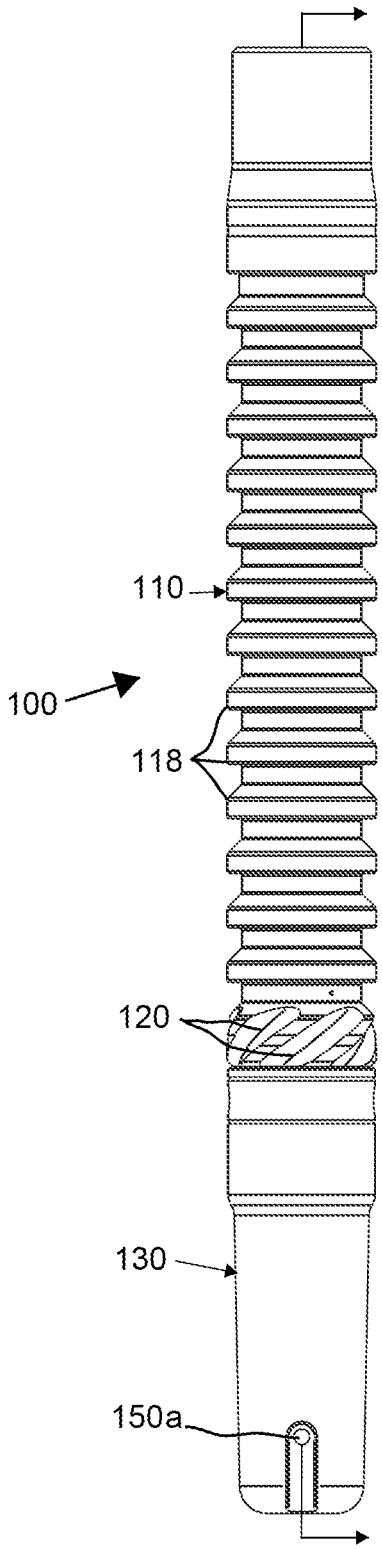
FIGS. 3A and 3B are side and cross-sectional views, respectively, of the plunger of FIG. 2A.
Figure 3B:
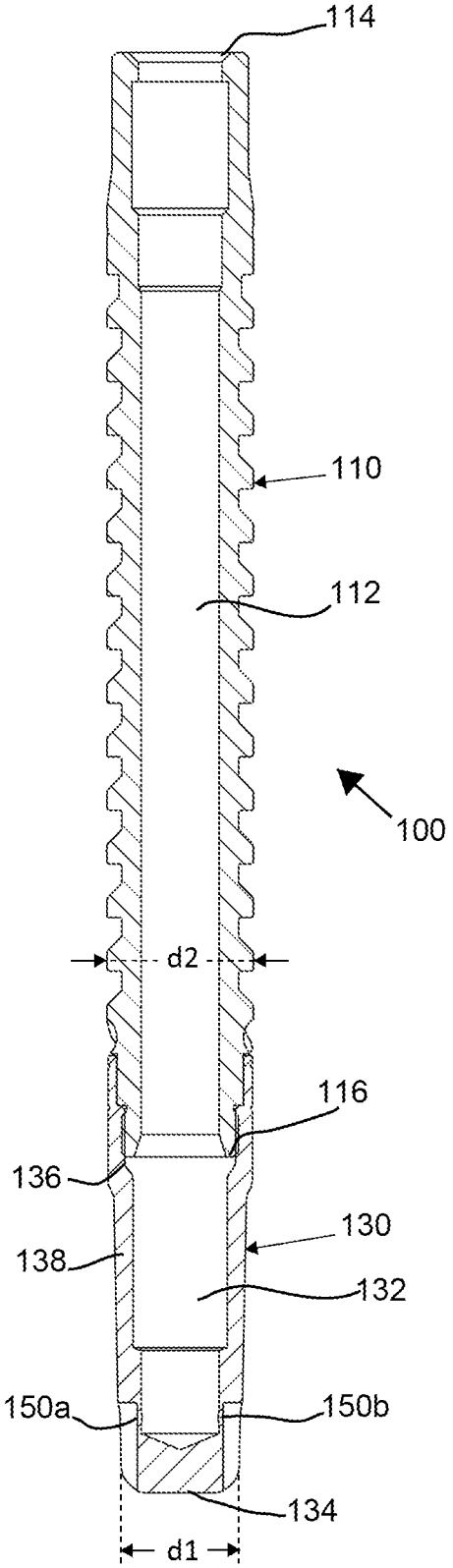

FIGS. 2A and 2B illustrate a perspective view and an exploded perspective view of the plunger 100 in accordance with one embodiment of the presented disclosure. FIGS. 3A-3B illustrate side and cross-sectional side views of this embodiment of the plunger 100. In the present embodiment, the plunger 100 includes two primary components—a mandrel or plunger body 110 and a closed lower end or cone 130. In the illustrated embodiment, the body 110 and cone 130 are shown as separate components that may be fixedly attached. In such an embodiment, the cone 130 may have a set of internal threads (e.g., female threads; not shown) that mate with a set of external threads (e.g., male threads; not shown) to fixedly attach the cone 130 to a lower end of the plunger body 110. Other connections (e.g., crimping, welding, etc.) are possible. It will be further appreciated that the plunger 100 may be formed (e.g., milled) from a single piece of material (e.g., metal, metal alloy, etc.) such that the plunger body 110 and cone 130 are integrally formed.

The plunger body 110 (e.g., mandrel) forms an upper portion of the plunger 100 and is defined by a generally cylindrical sleeve having a hollow interior defining a fluid passage (e.g., central passageway) or flow path 112 through which production fluids may pass when the plunger 100 descends into a well. Likewise, the flow path 112 allows for a transfer of gas across the plunger 100 from the well bottom into a liquid load above the plunger 100 during plunger lift or ascent. In the illustrated embodiment, the hollow interior or fluid flow path 112 extends between an open top end 114 and an open bottom end 116 of the plunger body 110. The open upper end 114 of the fluid flow path 112 exits the top of the plunger 100 (e.g., when viewed through production tubing in which the plunger 100 is placed; not shown) and the open bottom end 116 exits through a bottom of the plunger body 110. In the illustrated embodiment, an exterior sidewall of the plunger body 110 includes a series of solid rings 118. However, it will be appreciated that various other sidewall geometries are possible (pads, brush, etc.) and within the scope of the present disclosure. By way of example, various sidewall geometries are illustrated in U.S. Pat. No. 7,438,125, the entirety of which is incorporated herein by reference. In the illustrated embodiment, the plunger body 110 also includes a set of spiraled or helical rings 120 that impart a twisting motion to the plunger 100 during descent and ascent to reduce friction between the plunger body 110 and an interior of production tubing. Though illustrated in the presented embodiment, it will be appreciated that the spiraled rings 120 are optional and may be omitted in various embodiments.

As shown, the cone 130 is disposed at the bottom end of the plunger body 110. The cone 130 has a hollow interior 132 that extends from near a closed bottom end 134 of the cone 130 to an open upper end 136. In the embodiment where the cone 130 and the plunger body 110 are separate elements, the cone 130 is generally cup-shaped having a closed bottom end 134 and an annular sidewall 138 extending from the closed bottom end to an upper open end 136 (e.g., upper annular edge). The flow path 112 through the plunger body 110 opens into the hollow interior 132 of the cone 130 such that the interiors of the plunger body 110 and the cone 130 are in fluid communication.

To enhance the ability of the plunger 100 to pass through liquids within production tubing during descent, the closed bottom end 134 of the cone 130 has a diameter 'd1' that is smaller than an outside diameter 'd2' of the plunger body 110. In this regard, the cone 130 generally tapers from the lower end diameter d1 to a larger diameter d2 where the cone 130 mates with the plunger body 110. Of note, such a taper need not be uniform over a length of the cone 130 between its bottom end 134 and its upper end 136. The smaller diameter bottom end of the cone 130 and the tapering of the cone portion of the plunger 100 facilitates passage of the plunger 100 through liquids accumulated in the well bottom during descent.

Figure 4:
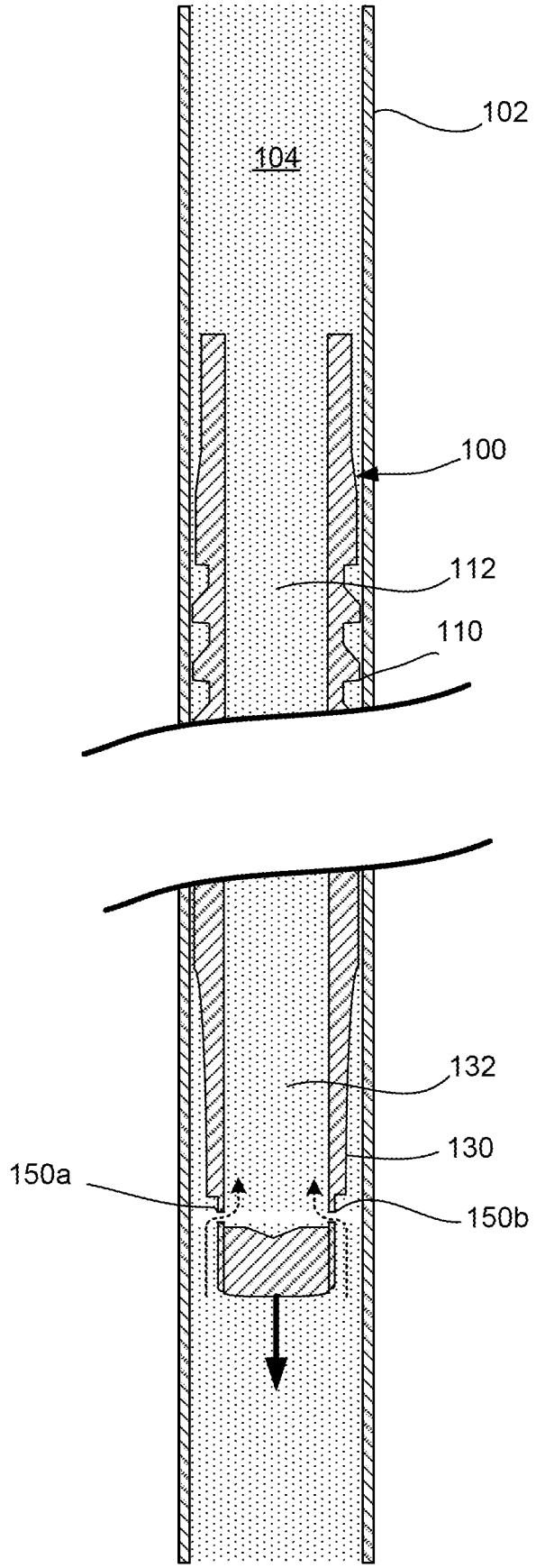
FIG. 4 illustrates the plunger descending in production tubing.

To further enhance both plunger descent and plunger ascent, the plunger 100 includes one or more apertures or orifices 150*a*, 150*b* (hereafter 150 unless specifically referenced), which permit fluids to pass across the plunger 100. These orifices 150 provide fluid communication between production tubing below the plunger 100 and the central passageway 112 of the plunger body 110 and/or the hollow interior 132 of the cone 130. Of note, the central passageway 112 of the plunger body 110 and the hollow interior 132 of the cone 130 may be defined by a single passageway having a closed bottom end (i.e., exiting through the top of the plunger 100) in embodiments where the plunger body 110 and cone 130 are integrally formed. In any embodiment, the orifices 150 permit fluids (e.g., production liquids) to pass upward through the central passageway 112 while the plunger 100 descends into production tubing. This is illustrated in FIG. 4, which shows, in cross-section, a plunger 100 disposed within production tubing 102. As shown, the plunger 100 is moving downward through fluid 104 within the production tubing 102. While passing through the fluid 104, a portion of the fluid passes through the orifices 150 (i.e., as illustrated by the dashed arrows), through the central passageway 112 and exits through the top of the plunger 100. This arrangement facilitates plunger descent as the fluid 104 has an additional path across the plunger 100. That is, not all the fluid has to pass between the outside surface of the plunger 100 and the inside surface of the production tubing 102 during plunger descent. The passage of such fluid across the plunger 100 through the central passageway 112 allows the plunger 100 to descend through such liquids (e.g., accumulated liquids at the bottom of a production well) at a higher rate than a plunger lacking such a central passageway and orifices. In this regard, the plunger 100 may operate similar to a by-pass plunger during descent. However, in contrast to by-pass plungers that typically utilize a check valve arrangement to open the plunger during descent and close the plunger during ascent, the presented plunger 100 may be entirely free of moving parts.

Figure 5:
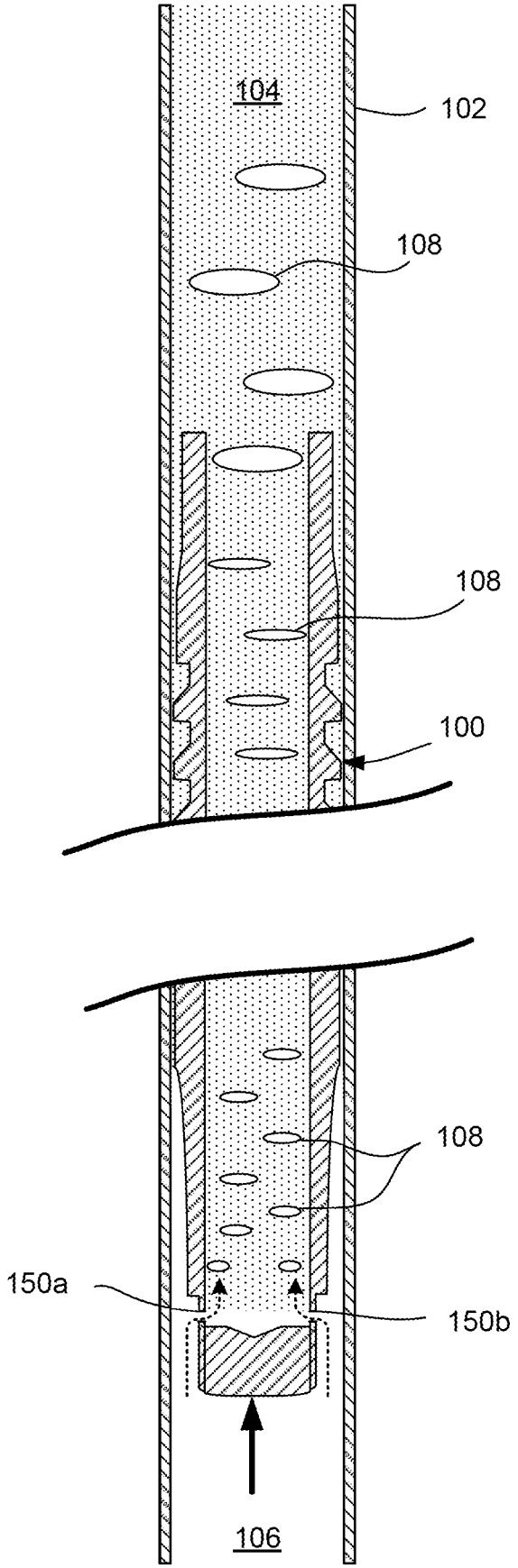
FIG. 5 illustrates the plunger ascending in production tubing.

The orifices 150 also allow for increasing a rate of plunger ascent. As previously noted, while a well is open gas accumulating below the plunger 100 pushes the plunger 100 and liquid above the plunger 100 in the production tubing to the surface. The orifices 150 permit a portion of the gas accumulating below the plunger 100 to flow through the plunger 100 during ascent. This is illustrated in FIG. 5. As shown, gas 106 within the production tubing propels the plunger 100 upward. Additionally, the orifices 150 permit a portion of the gas 106 below the plunger 100 to pass into the central passageway 112 and through the plunger 100. Stated otherwise, a portion of the gas passes through the plunger 100 and into the liquid load (e.g., production fluids) in and above the plunger 100. The gas transfer results in aeration of the fluid 104 and results in a liquid lift assist. That is, gas bubbles 108 (e.g., aeration) within the liquid load pass upward through the fluid providing lift to the liquid load. This allows the plunger 100 to carry a heavier liquid load to the well top as the aeration effectively lightens the load. Further, this may allow in increasing the ascent velocity of the plunger 100. Applying a soapy mixture down to the well bottom between the well casing and tubing can further assist the aeration process by allowing a higher surface tension in the gaseous bubbles formed within the liquid load. However, this is not a requirement.

Figure 6A:
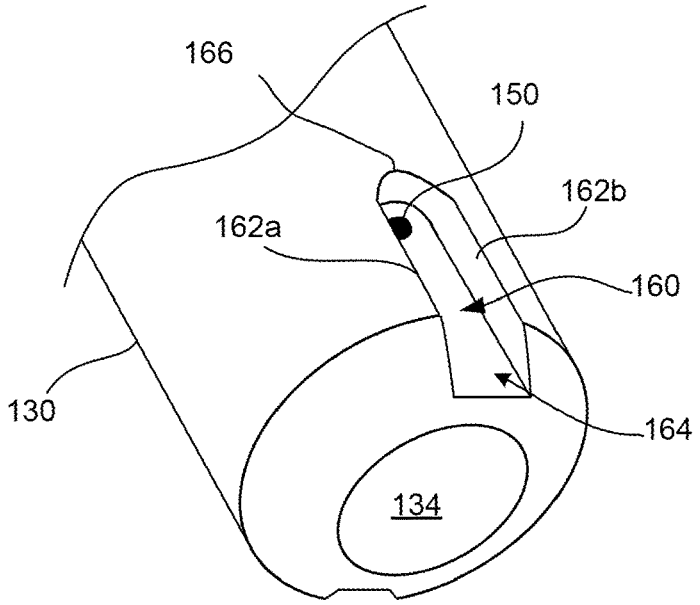
FIG. 6A illustrates a perspective view of the lower cone of the plunger.
Figure 6B:
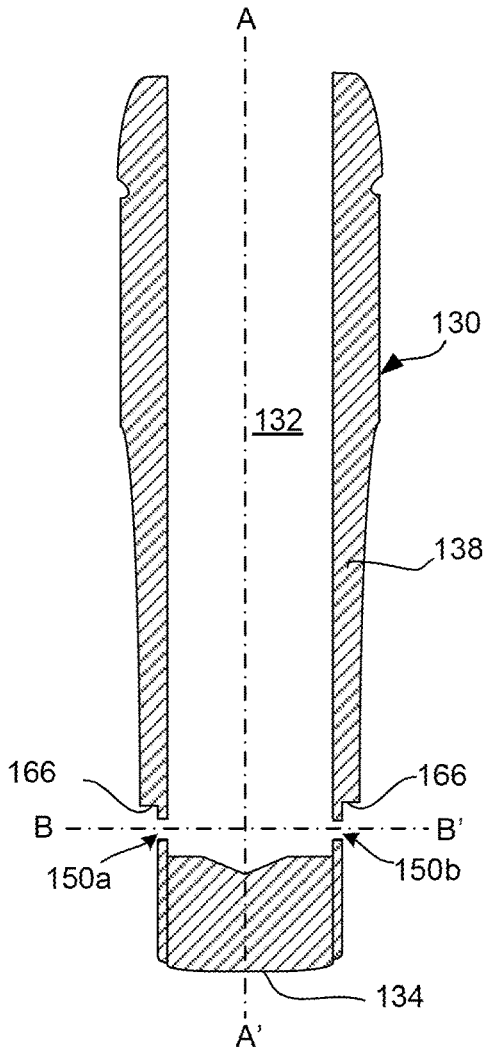
FIG. 6B illustrates a cross-sectional view of the lower cone of the plunger.

FIGS. 6A and 6B illustrate the lower end or cone 130 of the plunger 100. As shown, the orifices 150 are each disposed within a recessed channel 160 formed into the sidewall 138 of the cone 130. The recessed channel 160 has an open end 164 that opens to the bottom of the plunger 100. The recessed channel 160 extends from the open end 164 to a closed upper end 166. First and second sidewalls 162*a*, 162*b* and a bottom surface extend between the ends of the recessed channel 160. In this embodiment, the orifices 150 are formed through the bottom surface of the recessed channel 160 proximate to the closed upper end 166. The closed upper end 166 of the recessed channel 160 helps direct liquids into the orifices 150 during plunger descent. That is, when the orifices 150 pass through the sidewall 138 of the lower portion of the plunger 100 (e.g., cone 130), the closed upper end 166 of the recessed channel 160 forms a hood that helps direct liquid into the interior 132 of the cone 130 or fluid path through the plunger body 110. Of note, while considered beneficial, the recessed channels 160 are optional.

As further illustrated by FIG. 6B, the centerline axis B-B' of the orifices 150 is typically non-aligned with the centerline axis A-A' of the plunger 100. In the illustrated embodiment, the centerline axes of the two orifices 150 are transverse (e.g., perpendicular) to the centerline axis of the plunger 100. However, it will be appreciated that the centerline axes of the orifices 150 may be angled relative to the centerline axis of the plunger 100.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A plunger for use in a hydrocarbon well, comprising:

a generally cylindrical body having a fluid flow path extending axially through the cylindrical body along a centerline axis of the cylindrical body from an opening in a top surface to an opening in a bottom surface, the cylindrical body having an outside diameter configured for receipt within production tubing, wherein the fluid flow path exits through an upper end of the cylindrical body;

a cone attached to a lower end of the cylindrical body containing the bottom surface, the cone extending from the lower end of the cylindrical body to a bottom end, the bottom end having a second cross-dimension that is smaller than the outside diameter of the cylindrical body; and at least a first orifice passing through the cone, wherein the first orifice fluidly connects the fluid flow path to an outside surface of the cone; and wherein a centerline axis of the first orifice is non-aligned with the centerline axis of the cylindrical body.

2. The plunger of claim 1, wherein the cylindrical body and the cone are integrally formed.

3. The plunger of claim 1, wherein the fluid flow path extends into the cone.

4. The plunger of claim 3, wherein the bottom end of the cone is a closed bottom end.

5. The plunger of claim 4, wherein the cone further includes an annular sidewall extending between the closed bottom end and the lower end of the cylindrical body.

6. The plunger of claim 5, wherein an interior of the cone defined by the annular sidewall between the closed bottom end and the lower end of the cylindrical body is hollow.

7. The plunger of claim 5, wherein the annular sidewall tapers from the second cross-dimension of the bottom end to the outside diameter of the cylindrical body.

8. The plunger of claim 5, wherein the first orifice extends through the annular sidewall of the cone.

9. The plunger of claim 8, further comprising:

a second orifice that extends through the annular sidewall of the cone.

10. The plunger of claim 9, wherein the first orifice and the second orifice are disposed on opposite sides of the cone.

11. The plunger of claim 8, further comprising a recessed channel formed in an outside surface of the cone, wherein the first orifice is disposed within the recessed channel.

12. The plunger of claim 11, wherein the recessed channel includes an open lower end, a closed upper end and first and second side surfaces.

13. The plunger of claim 12, wherein the first orifice extends through a bottom surface of the recessed channel proximate to the closed upper end.

14. The plunger of claim 1, wherein the centerline axis of the first orifice is perpendicular to the centerline axis of the cylindrical body.

15. A plunger for use in a hydrocarbon well, comprising: a generally cylindrical body having a fluid flow path extending axially through a portion of the cylindrical body from an opening through the top surface of the cylindrical body to a closed bottom end of the cylindrical body; and at least a first orifice passing through a sidewall surface of the cylindrical body proximate to the closed bottom end, wherein the first orifice fluidly connects the fluid flow path extending through the top surface of the cylindrical body to a lower outside surface of the cylindrical body, wherein the sidewall surface of the cylindrical body is free of orifices proximate to the top surface.

16. The plunger of claim 15, wherein an upper portion of the cylindrical body has an outsider diameter configured for receipt within production tubing.

17. The plunger of claim 16 wherein the closed bottom end of the cylindrical body has an end diameter that is smaller than the outside diameter of the upper portion of the cylindrical body.

18. The plunger of claim 16, wherein a sidewall of a lower portion of the cylindrical body tapers from the closed bottom end to the upper portion of the cylindrical body.

19. The plunger of claim 18, wherein the first orifice passes through the sidewall of the lower portion of the cylindrical body.

20. The plunger of claim 15, wherein the plunger is free of parts configured to move during use in production tubing.

21. The plunger of claim 15, wherein the cylindrical body includes helical rings on the lower outside surface.

* * * * *